US005551579A

United States Patent [19]

Converse

[11] Patent Number: 5,551,579

[45] Date of Patent: Sep. 3, 1996

[54] WALL MOUNTED GOLF EQUIPMENT STORAGE CADDY

[76] Inventor: William L. Converse, 640 Perry Rd., Strykersville, N.Y. 14145

[21] Appl. No.: 374,848

[22] Filed: Jan. 19, 1995

Related U.S. Application Data

[63] Continuation-in-part of Ser. No. 115,762, Oct. 18, 1993, abandoned.

[51] Int. Cl.[6] ..... A47F 7/00

[52] U.S. Cl. ..... 211/70.2; 211/60.1; 211/88; 248/96; 248/205.2

[58] Field of Search ..... 211/87, 88, 89, 211/34, 35, 37, 70.2, 4, 60.1; 248/96, 205.2, 309.1, 311.2

[56] References Cited

U.S. PATENT DOCUMENTS

| | | | |
|---|---|---|---|
| 2,902,238 | 9/1959 | Tolman | 248/96 |
| 4,878,585 | 11/1989 | Orestano | 248/205.2 X |
| 4,951,910 | 8/1990 | March | 248/205.2 X |
| 5,014,955 | 5/1991 | Thompson | 248/309.1 |
| 5,087,003 | 2/1992 | Montgomery | 248/96 |
| 5,178,444 | 1/1993 | May et al. | 211/4 X |
| 5,199,581 | 4/1993 | Arnold | 248/96 X |
| 5,351,983 | 10/1994 | Descalo | 248/96 X |

*Primary Examiner*—Robert W. Gibson, Jr.
*Attorney, Agent, or Firm*—Howard J. Greenwald

[57] ABSTRACT

A wall mounted golf equipment storage caddy is disclosed. The top of the golf bag is secured in place by a Velcro adhesive fastener which is attached to the top portion of the main support member. The base of the golf bag is contained inside a cup-like appendage protruding from the lower portion of the main support member. Below the cup-like appendage, also protruding from the main support member, is a shoe storage compartment. The latter compartment is open in front, which permits storage of a pair of golf shoes. The apparatus of the invention can be placed in a compact folded-up position so that it is out of the way when not in use.

5 Claims, 3 Drawing Sheets

WALL MOUNTED GOLF EQUIPMENT STORAGE CADDY

This is a continuation-in-part of application Ser. No. 08/115,762, filed Oct. 18, 1993 abandoned.

BACKGROUND OF THE INVENTION

1. Field of Invention

This invention is in the field of storage equipment for storing golf equipment.

2. Description of the Prior Art

Golf bag "hangers" are known in the artsuch as in U.S. Pat. No. 5,199,581 to Arnold. This patent appears to disclose a series of mental "fingers" used to support a golf bag at its strap ring and having bent wire elements used to support golf shoes.

SUMMARY OF THE INVENTION

This invention is directed to a wail mounted golf equipment storage caddy which supports a golf bag at its top portion by an adhesive fastener, and at the base of the golf bag by a cup-like appendage, or base for a golf bag, which protrudes from a main support member. Also protruding from the main support member below the cup-like appendage is a shoe storage compartment.

DETAIL DESCRIPTION OF THE DRAWINGS

Figure 1:
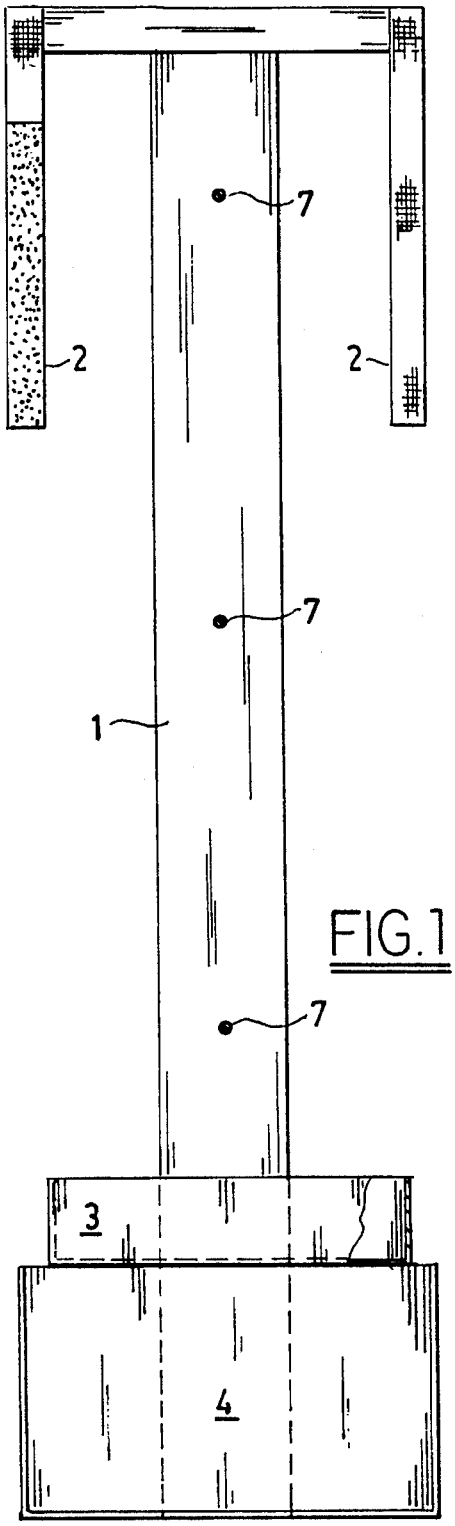
FIG. 1 shows a front view of the apparatus of the invention which has provisions for holding a golf bag in the upright position.

With reference to FIG. 1, there is shown a main support member 1 in the upright position ready to receive a golf bag (not shown) which is in the upright position. The golf bag is held in place at the top of the golf bag by a Velcro adhesive fastener 2. The lower portion of the golf bag is held in the cup-like appendage 3 which is attached at the lower end of the main support member 1. Below the cup-like appendage, and protruding from the main member support below the cup-like appendage, is a shoe storage compartment 4.

Figure 2:
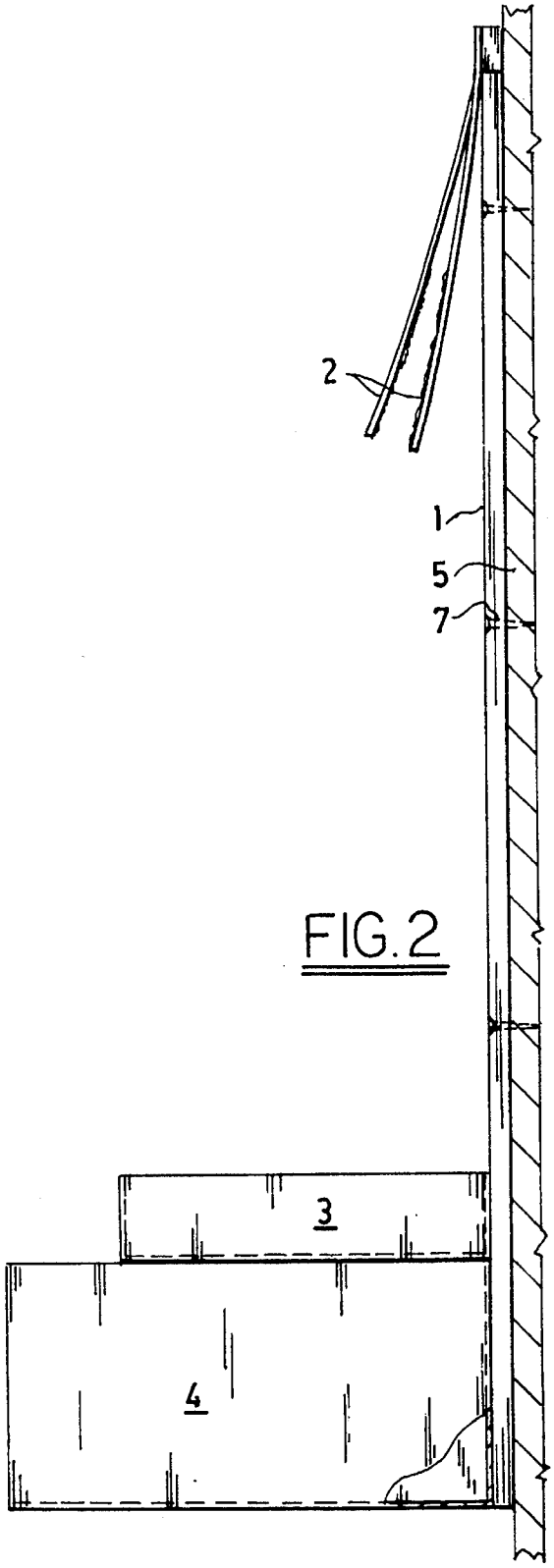
FIG. 2 is a side view of the apparatus of the invention which shows how the golf storage caddy of the invention can be attached to a wall for the purpose of supporting the storage caddy in the upright position.

FIG. 2 shows a side view of the apparatus of the invention with the main support member 1 in a position to be attached to a wall stud 5 by suitable bolts 7 or screws or other fasteners. Also shown in FIG. 2 is the cup-like appendage 3 capable of supporting the weight of the golf bag and beneath the cup-like appendage 3 is a shoe storage compartment 4.

Figure 3:
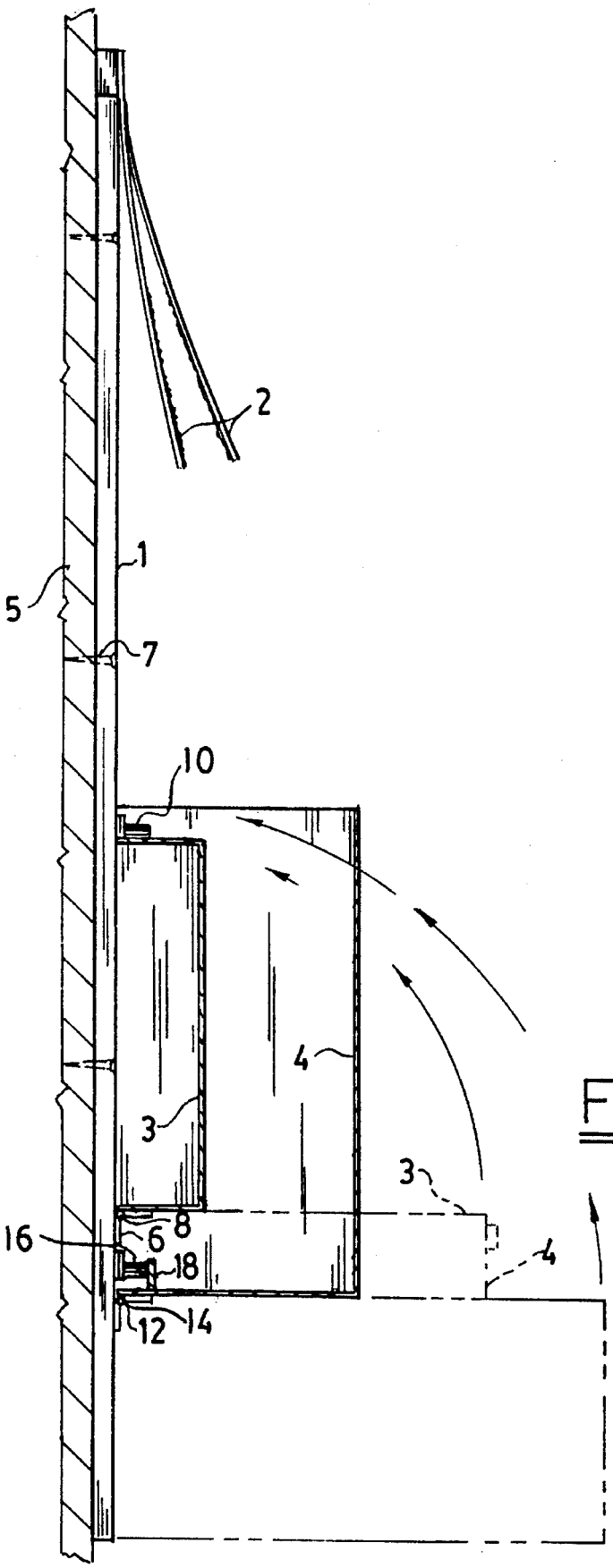
FIG. 3 shows a side view of the apparatus of the invention which shows how the golf storage caddy of the invention can be folded up against a wall when the caddy is not in use.

FIG. 3 shows a side view of the apparatus of the invention with the main support member 1 in a position to be attached to a wall stud 5 by suitable bolts 7 or screws or other fasteners. Cup-like appendage 3 is capable of supporting the weight of a golf bag. Beneath the cup-like appendage 3 is a shoe compartment 4.

In FIG. 3, the apparatus of the invention is in a compact folded up position so that it is out of the way when not in use. The appendage 3 is folded by means of one or more hinges 6 that may be equipped with a spring loading mechanism 8 that automatically raises appendage 3 when the weight of the golf bag is removed. Hinges 6 can be conventional hinges or special hinges such as piano hinges. Moreover, the apparatus may be held in folded position with the aid of magnetic fasteners 10 positioned at the front of the cup-like appendage 3, and positioned on the main support member 1 which causes a fastening effect when the appendage 3 is raised to the folded position.

In a similar manner, the shoe compartment 4 can be folded up when not in use. The shoe compartment 4 is folded by means of one or more hinges 12, that may be equipped with a spring loading mechanism 14, that automatically raises the shoe compartment 4 when the weight of the shoes is removed. The shoe compartment 4 can be held in the folded position with the aid of magnetic fasteners 16, which are connected to a cross bar or cross plate 18 in the shoe compartment 4 and positioned on the main support member 1 which causes a fastening effect when shoe compartment 4 is in the raised position.

Figure 4:
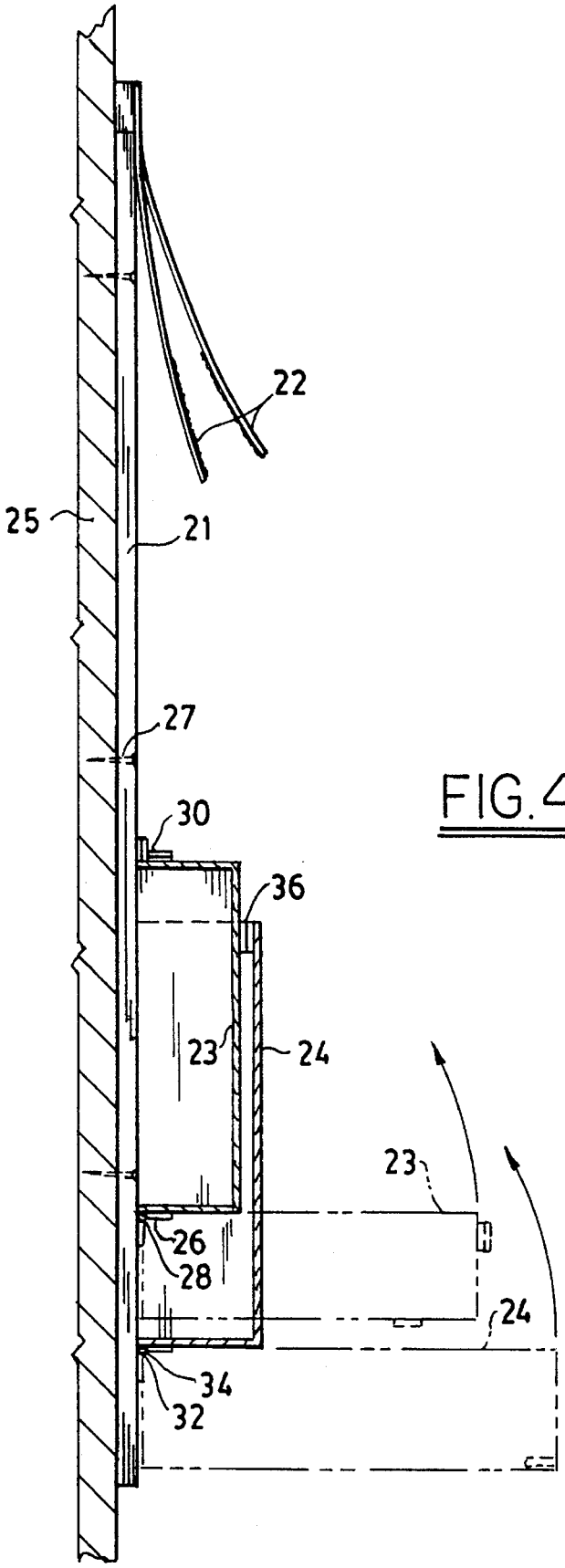
FIG. 4 shows a side view of another embodiment of the apparatus of the invention which shows how the golf storage caddy of the invention can be folded up against a wall when the caddy is not in use.

FIG. 4 shows a side view of the apparatus of the invention with the main support member 21 in a position to be attached to a wall stud 25 by suitable bolts 27 or screws or other fasteners. Cup-like appendage 23 is capable of supporting the weight of a golf bag. Beneath the cup-like appendage 23 is a shoe compartment 24.

In FIG. 4, the apparatus of the invention is in a compact folded up position so that it is out of the way when not in use. The appendage 23 is folded by means of one or more hinges 26 that may be equipped with a spring loading mechanism 28 that automatically raises appendage 23 when the weight of the golf bag is removed. Hinges 26 can be conventional hinges or special hinges such as piano hinges. Moreover, the apparatus may be held in folded position with the aid of magnetic fasteners 30 positioned at the front of the cup-like appendage 23, and positioned on the main support member 21 which causes a fastening effect when the appendage 23 is raised to the folded position.

In a similar manner, the shoe compartment 24 can be folded up when not in use. The shoe compartment 24 is folded by means of one or more hinges 32, that may be equipped with a spring loading mechanism 34, that automatically raises the shoe compartment 24 when the weight of the shoes is removed. The shoe compartment 24 can be held in the folded position with the aid of magnetic fasteners 36, which are connected at the bottom of appendage 23 and positioned on the inside base of the shoe compartment 24 which causes a fastening effect when the shoe compartment is in the raised position.

The spring loading of the hinges can keep the appendage or shoe box in an up-right position even without use of the magnetic fasteners.

As can be seen from the foregoing drawings, a wall mounted equipment caddy of the invention provides safe storage for a golf bag and golf shoes. The golf equipment storage caddy is mounted to an existing wall by bolts or screws or other fasteners which pass through the main support member. The main support member can be made of wood, metal or plastic.

The golf bag base is first securely mounted inside a cup-like appendage. Then the top of the golf bag is attached to the main support member by a Velcro or other adhesive fastener, through the golf bag carrying handle or strap. The adhesive fastener can be made of any adhesive material so long as it can hold the golf bag in place under the weight of the golf bag. The adhesive fasteners are removably attached to the support member to allow for ready removal of the golf bag from the storage caddy of the invention. The adhesive fasteners may be in the form of a strap to hold the golf bag in place. Velcro adhesive fasteners are used in a preferred embodiment of the invention.

Situated below the cup-like appendage is a golf shoe compartment, also attached to the main support member.

I claim:

1. A wall mounted storage caddy which provides for the upright support of a golf bag comprising a vertically disposed main support member, an adhesive fastener located near the upper end of said main support member to secure the upper portion of said golf bag, a cup-like appendage attached near the lower end of said main support member to provide support for said golf bag, and a shoe compartment attached to said main support member below said cup-like appendage.

2. The storage caddy of claim 1 wherein said cup-like appendage and said shoe compartment are attached to said main support member by one or more hinges.

3. The storage caddy of claim 2 wherein said hinges are spring loaded.

4. The storage caddy of claim 2 wherein said cup-like appendage and said shoe compartment are being held in raised position by magnetic fasteners.

5. The storage caddy of claim 4 wherein said hinges are spring loaded.

* * * * *